US008464396B2

(12) United States Patent
Westby et al.

(10) Patent No.: US 8,464,396 B2
(45) Date of Patent: Jun. 18, 2013

(54) REMOVABLE HIDDEN HINGE PIN

(75) Inventors: Nathan L. Westby, Zimmerman, MN (US); Jeremy L. Fink, Anoka, MN (US); Trent T. Jones, White Bear Lake, MN (US)

(73) Assignee: Hoffman Enclosures Inc., Anoka, MN (US)

( * ) Notice: Subject to any disclaimer, the term of this patent is extended or adjusted under 35 U.S.C. 154(b) by 0 days.

(21) Appl. No.: 13/234,988

(22) Filed: Sep. 16, 2011

(65) Prior Publication Data

US 2013/0069511 A1 Mar. 21, 2013

(51) Int. Cl.
*E05D 5/12* (2006.01)

(52) U.S. Cl.
USPC ..... 16/380; 16/381; 16/386; 16/387

(58) Field of Classification Search
USPC ..... 16/380, 381, 386, 387, 266, 262, 16/268, 379
See application file for complete search history.

(56) References Cited

U.S. PATENT DOCUMENTS

| | | | | |
|---|---|---|---|---|
| 926,949 | A * | 7/1909 | Maas | 16/380 |
| 2,462,268 | A * | 2/1949 | Kahi | 70/1 |
| 3,769,928 | A * | 11/1973 | Kahl | 114/221 R |
| 4,190,929 | A | 3/1980 | Palka | |
| 4,340,992 | A * | 7/1982 | Lombardi | 16/349 |
| 4,482,023 | A * | 11/1984 | Dziedzic et al. | 180/89.17 |
| 4,570,290 | A * | 2/1986 | Anderson | 16/229 |
| 4,844,519 | A * | 7/1989 | Dagon | 292/57 |
| 4,858,274 | A | 8/1989 | Harrison et al. | |
| 5,259,091 | A | 11/1993 | Mordick | |
| 5,282,293 | A | 2/1994 | Pedoeem | |
| 5,666,695 | A | 9/1997 | Jegers et al. | |
| 5,722,121 | A | 3/1998 | Lau et al. | |
| 6,070,297 | A | 6/2000 | Borer | |
| 6,438,800 | B1 * | 8/2002 | Narang et al. | 16/389 |
| 6,721,994 | B2 * | 4/2004 | Bowman et al. | 16/262 |
| 7,805,811 | B2 * | 10/2010 | Shuker | 16/380 |
| 7,891,056 | B2 * | 2/2011 | McAfee | 16/374 |
| 2002/0095744 | A1 | 7/2002 | Narang et al. | |
| 2002/0121003 | A1 | 9/2002 | Shuker | |
| 2008/0104798 | A1 | 5/2008 | Hoppe et al. | |

FOREIGN PATENT DOCUMENTS

| | | |
|---|---|---|
| EP | 0916793 | 5/1999 |

* cited by examiner

*Primary Examiner* — Chuck Y. Mah
(74) *Attorney, Agent, or Firm* — Quarles & Brady LLP

(57) ABSTRACT

Embodiments of the invention provide a hinge apparatus that can include a hinge body having a first portion and a second portion and a hinge pin. The hinge pin can include an axial portion and a gripping portion. The hinge body can include a recess in one of the first portion and the second portion. The recess in the hinge body can receive the gripping portion of the hinge pin to inhibit access to the gripping portion when the hinge body is in the closed position. The gripping portion can be removed from the recess as the hinge body is moved to the open position.

24 Claims, 7 Drawing Sheets

REMOVABLE HIDDEN HINGE PIN

CROSS REFERENCE TO RELATED APPLICATIONS

None.

BACKGROUND

Hinges having a hinge body that receives a hinge pin are used in a variety of environments. One such environment that hinges are used in is for enclosures that house electrical or electronics equipment. These hinges can include a hinge body and leaf that are integral with the enclosure itself, or may include a two-piece hinge body that has one component attached to the enclosure frame and the other component attached to the door of the enclosure.

In such enclosures, it is common to use an inexpensive pinned hinge wherein the hinge bodies are welded directly to the enclosure frame and door. However, the hinges from these enclosures cannot be removed, which may get in the way of maintenance or installation for components housed within the enclosure or other activities that would benefit from removing the door from the enclosure. Thus, removable hinges have been used in electrical enclosures to facilitate such activities.

However, removable hinges may provide unintended access to the components of an electrical enclosure through an individual disassembling the hinge from its exterior to remove the door of the enclosure. Thus, it would be beneficial to provide a secure hinge design that resists uninhibited disassembly, but also is removable should the need arise to remove the door from the enclosure by appropriate personnel. It would also be beneficial to provide a hinge design that incorporates these features in a hinge body that is easy to manufacture, as well as addresses other common issues with removable hinge designs.

SUMMARY OF THE INVENTION

Some embodiments of the invention provide a hinge apparatus. The hinge apparatus can be configured to move between a closed position and an open position. The hinge apparatus can include a hinge body having a first portion and a second portion. The first portion can have a first knuckle portion and the second portion can have a second knuckle portion. The first knuckle portion and the second knuckle portion can define a tubular opening when aligned. One of the first portion and the second portion can include a recess. The hinge apparatus can also include a hinge pin having an axial portion and a gripping portion. The gripping portion can be offset from an axis of the hinge pin. The axial portion of the hinge pin can be received by the tubular opening and the gripping portion of the hinge pin can be received by the recess to inhibit access to the gripping portion when the hinge body is in the closed position. The gripping portion can be removed from the recess as the hinge body is moved to the open position.

In another embodiment, the invention can provide a hinge body configured to move between a closed position and an open position. The hinge body can include a first portion having a first knuckle portion and can also include a second portion having a second knuckle portion. The first knuckle portion and the second knuckle portion can define a tubular opening when aligned. One of the first portion and the second portion can have a recess. The recess can inhibit access to a gripping portion of a hinge pin when the hinge body is in the closed position. The hinge body can remove the gripping portion from the recess as the hinge body is moved to the open position.

The invention can also provide an enclosure that includes an enclosure frame, a door, a hinge body, and a hinge pin. The door can be configured to move between an open position and a closed position. The hinge body can include a first portion and a second portion. The first portion can have a first knuckle portion and the second portion can have a second knuckle portion. The first knuckle portion and the second knuckle portion can define a tubular opening when aligned. One of the first portion and the second portion can include a recess. The hinge pin can include an axial portion and a gripping portion. The axial portion of the hinge pin can be received by the tubular opening and the gripping portion of the hinge pin can be received by the recess to inhibit access to the gripping portion when the door is in the closed position. The gripping portion can be removed from the recess as the hinge body is moved to the open position.

These and other features, aspects, and advantages of the present invention will become better understood upon consideration of the following detailed description, drawings, and appended claims.

DETAILED DESCRIPTION

Figure 1:
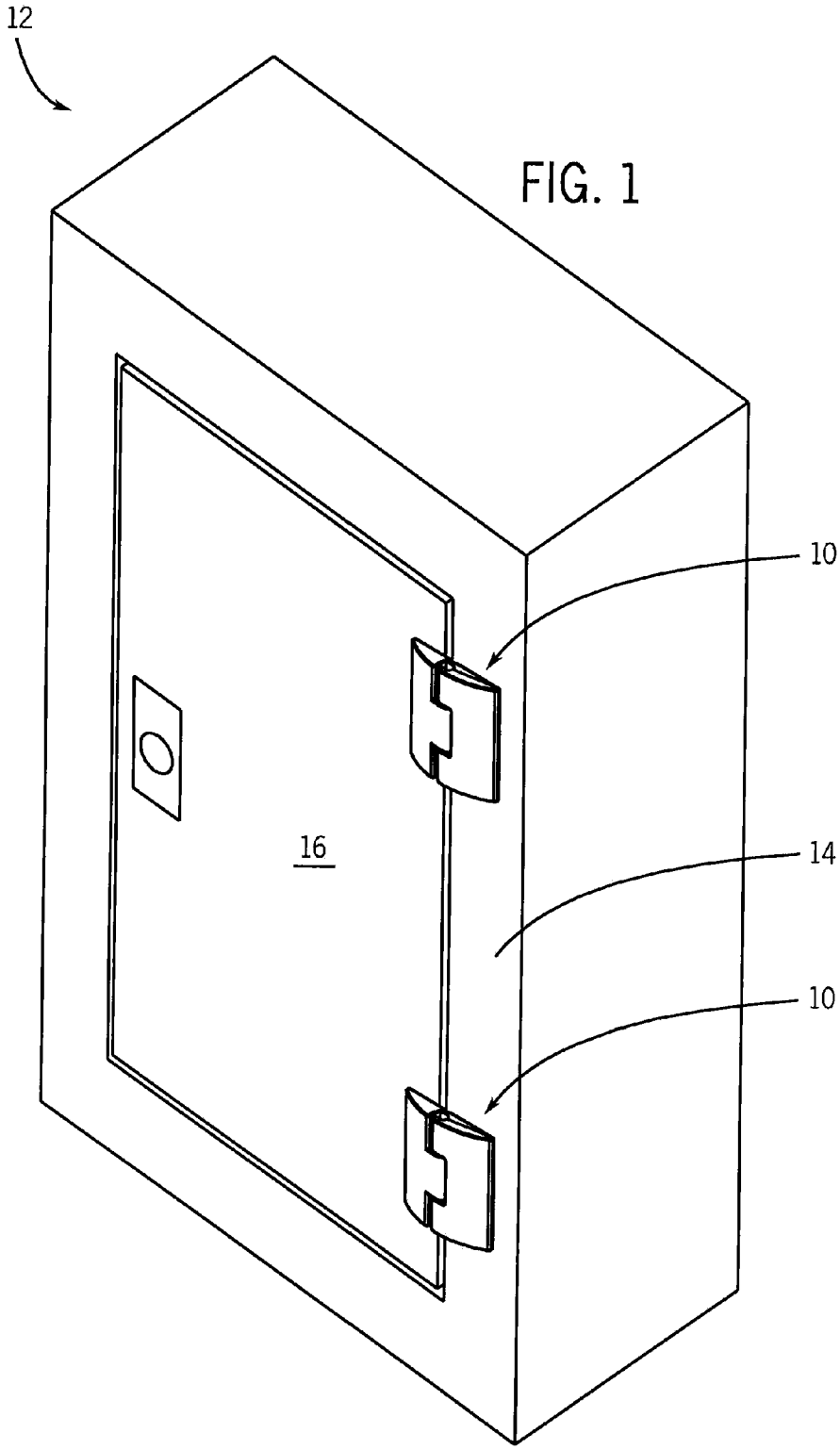
FIG. 1 is a front perspective view of an enclosure with two hinge apparatuses, with the door of the enclosure and the hinge bodies of the hinge apparatuses being in the closed position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates two hinge apparatuses 10 attached to an enclosure 12. The enclosure 12 includes an enclosure frame 14 and a door 16. While the enclosure 12 of FIG. 1 illustrates two hinge apparatuses 10, enclosures can use one or three or more hinge apparatuses 10 depending on factors such as the size of the enclosure 12, the size of the door 16, and other factors.

Figure 2:
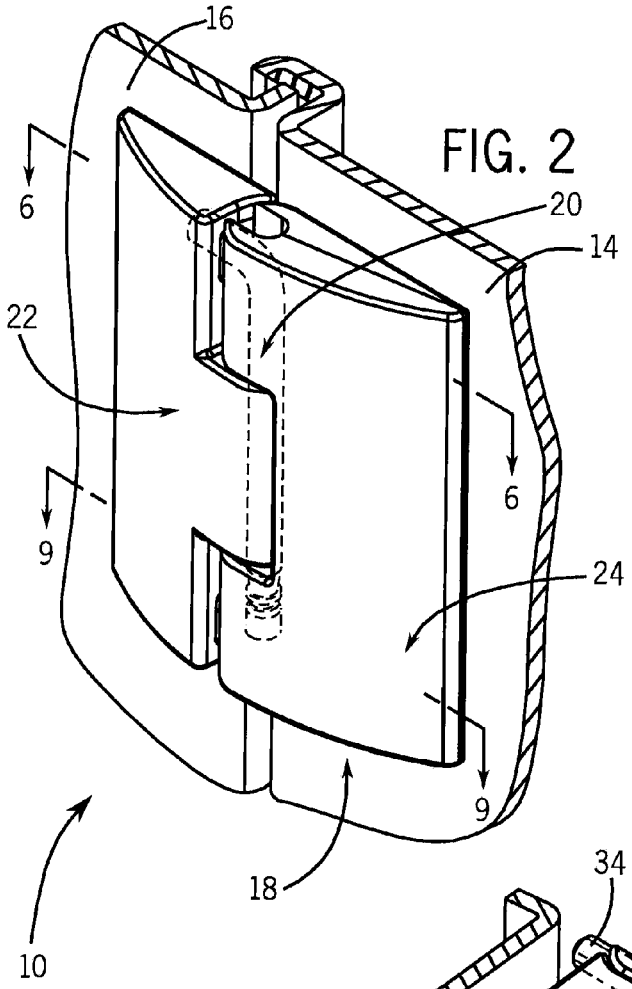
FIG. 2 is a detailed perspective view of one hinge apparatus and the enclosure of FIG. 1.
Figure 3:
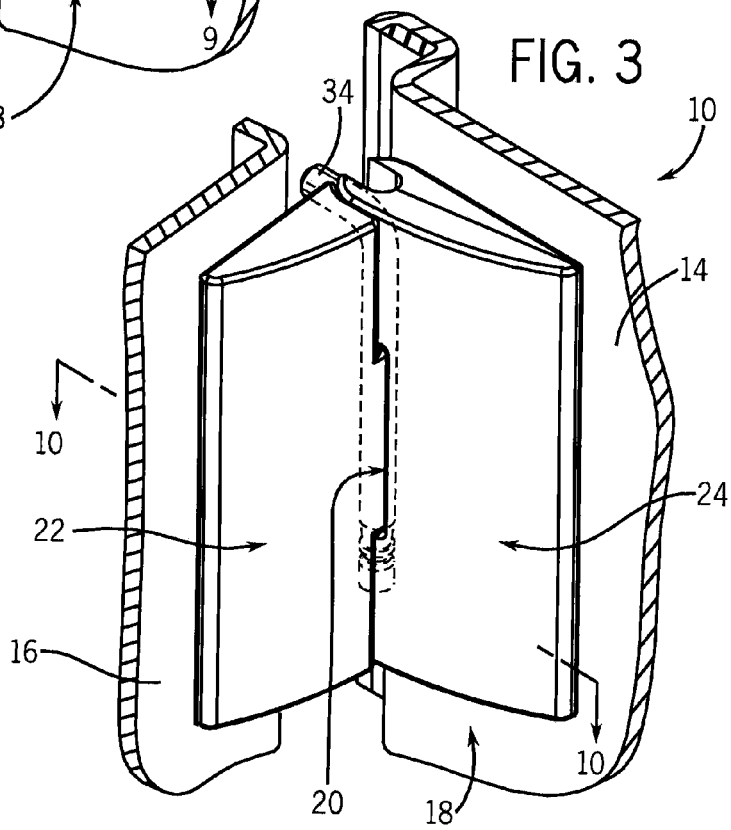
FIG. 3 is a detailed perspective view of one hinge apparatus and the enclosure of FIG. 2, with the hinge body and the door being in the open position.

As illustrated in more detail in FIGS. 2-3, the hinge apparatus 10 can include a hinge body 18 and a hinge pin 20. The hinge body 18 can include a first portion 22 and a second portion 24. As shown in FIG. 1, the hinge body 18 and the door 16 are in the closed position. In FIG. 3, the hinge body 18 and the door 16 are in the open position that allows access to the interior of the enclosure 12.

Figure 4:
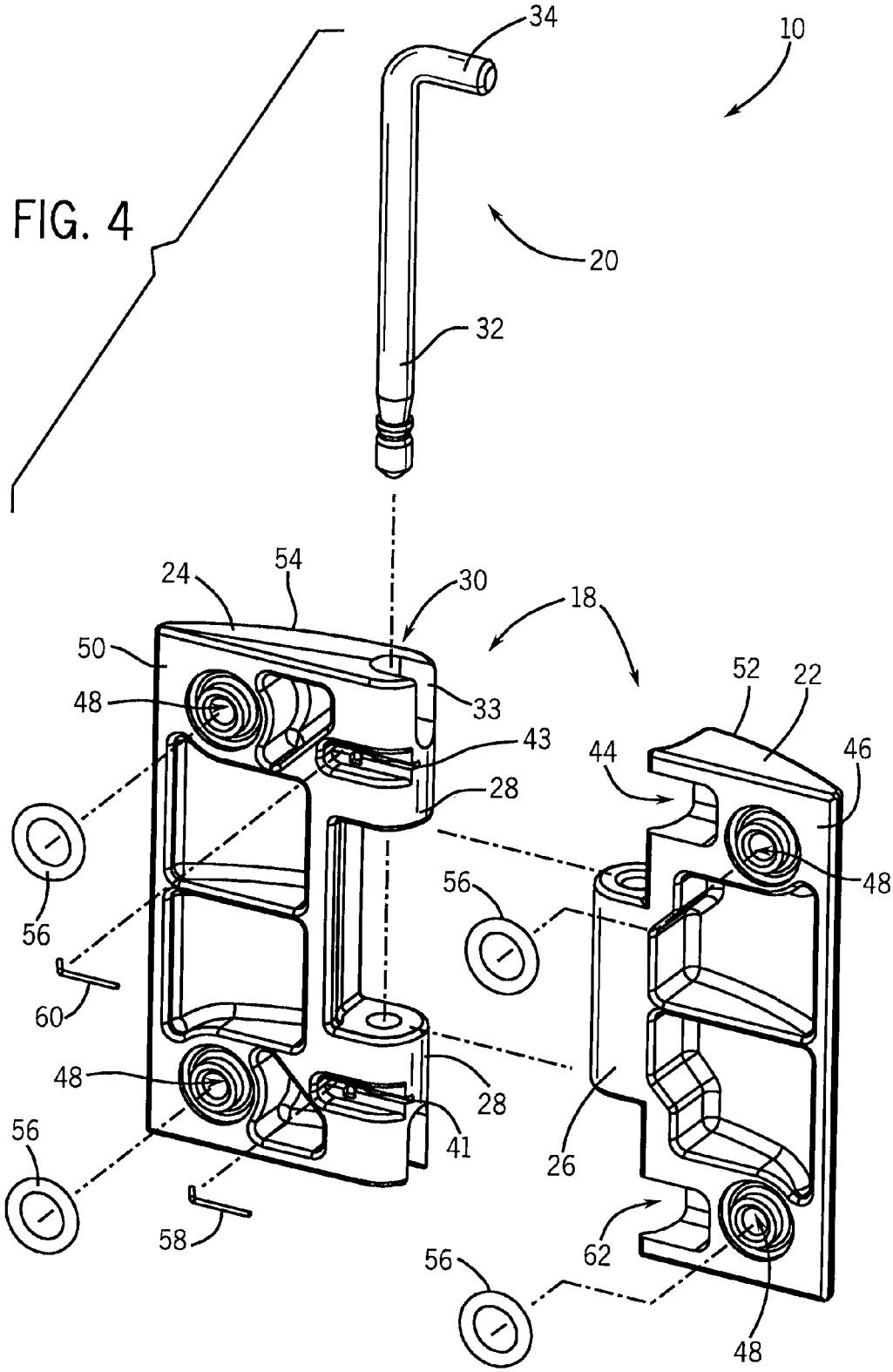
FIG. 4 is an exploded view of one of the hinge apparatuses of FIG. 1.

FIG. 4 illustrates an exploded view of the hinge apparatus 10 of FIG. 3. The hinge body 18 can include a first portion 22 having a first knuckle portion 26 and a second portion 24 having a second knuckle portion 28. When aligned, the first knuckle portion 26 and second knuckle portion 28 define a tubular opening 30. The tubular opening 30 can receive the hinge pin 20.

Figure 7:
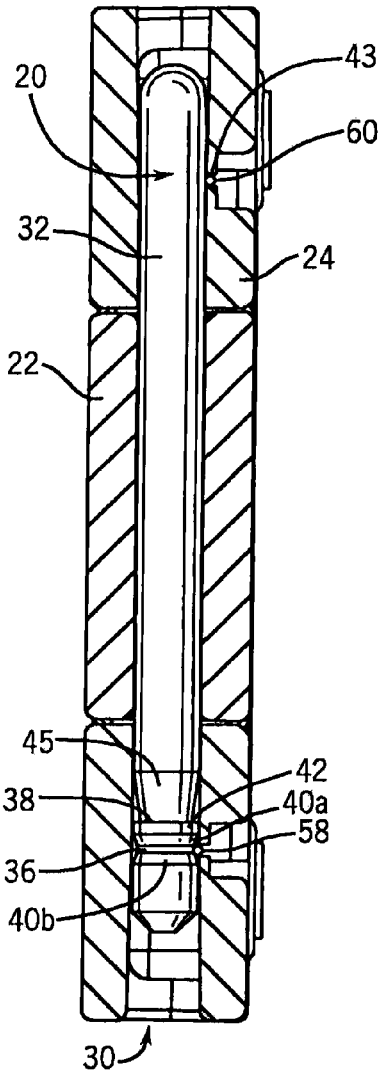
FIG. 7 is a cross-sectional view taken along line 7-7 of FIG. 6.

The hinge pin 20 can include an axial portion 32 and a gripping portion 34. The gripping portion 34 can be offset from the axial portion 32 of the hinge 20. For example, the gripping portion 34 can be offset from the axial portion 32 such that the hinge pin 20 is "L-shaped," however, the gripping portion 34 is not limited to such a shape or to being offset from the axial portion 32. As best illustrated in FIG. 7, the hinge pin 20 can include a first annular groove 36 and a second annular groove 38. Tapered portions 40*a*, 40*b* can be above and below the first annular groove 36 on the hinge pin 20. The second annular groove 38 can provide a shoulder 42. A tapered portion 45 can be above the second annular groove 38 and shoulder 42.

Figure 6:
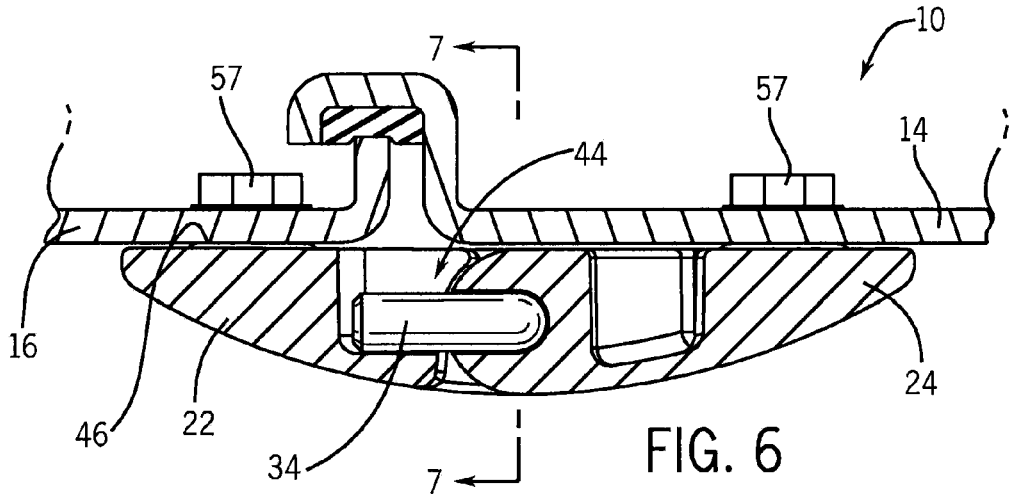
FIG. 6 is a cross-sectional view taken along line 6-6 of FIG. 2.
Figure 11:
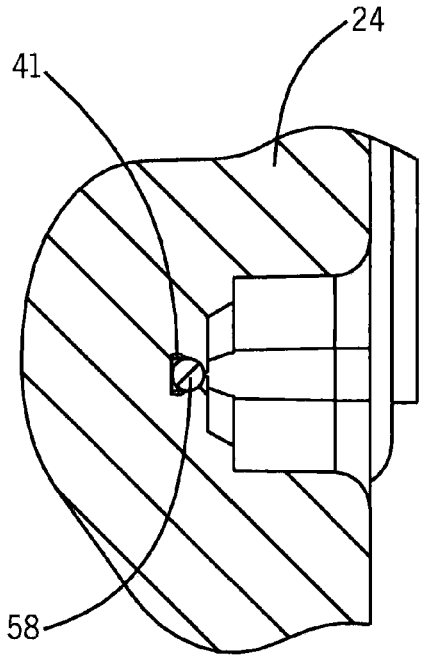
FIG. 11 is a cross-sectional view taken along line 11-11 of FIG. 9.
Figure 9:
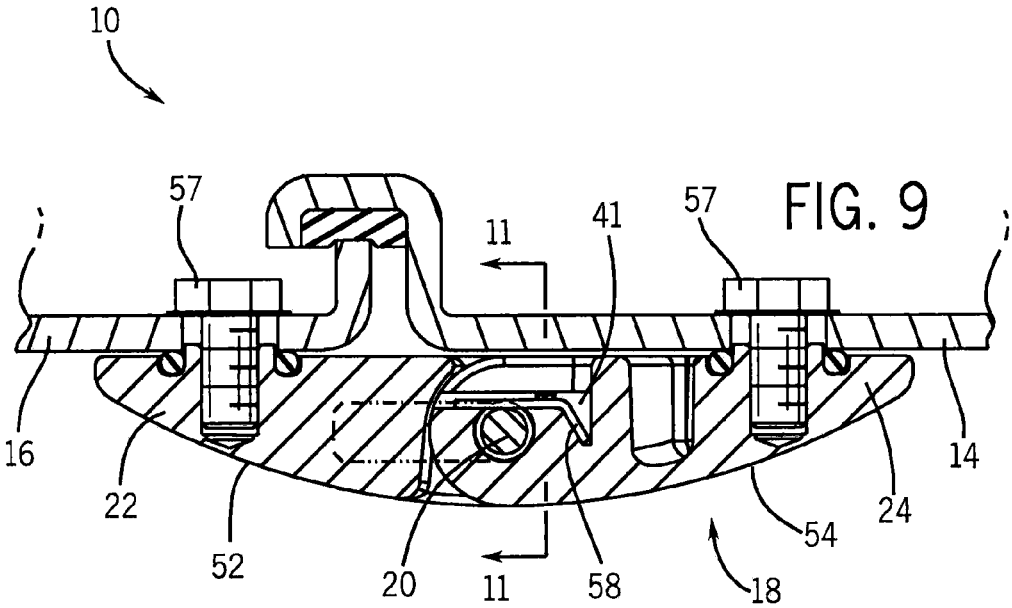
FIG. 9 is a cross-sectional view taken along line 9-9 of FIG. 2.
Figure 10:
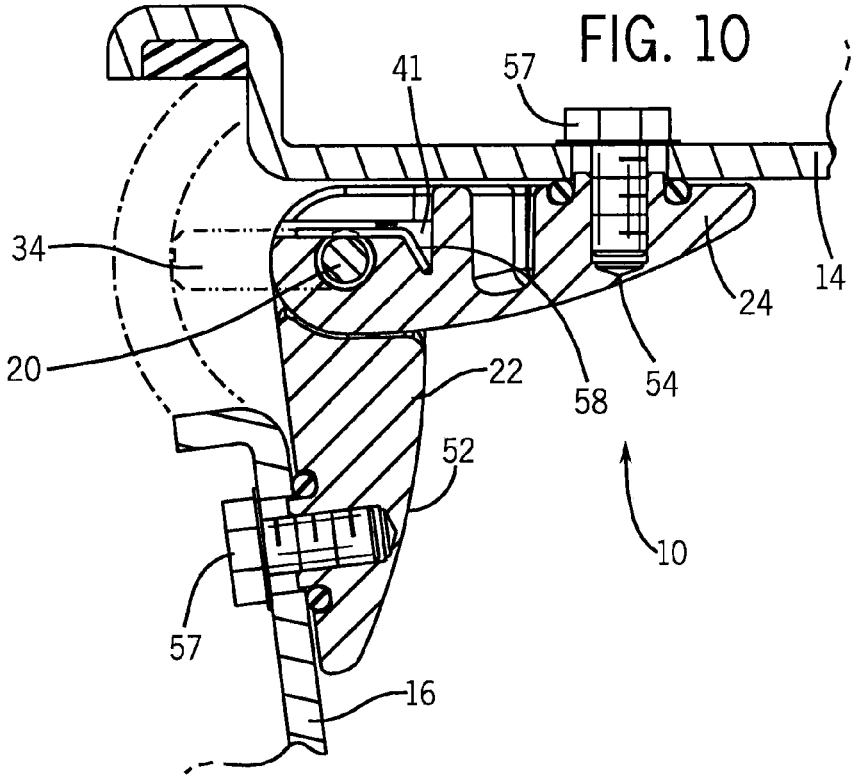
FIG. 10 is a cross-sectional view taken along line 10-10 of FIG. 3.

The hinge body 18 can also include mounting holes 48. The mounting holes 48 can extend from a back surface 46 of the first portion 22 toward a front surface 52 of the first portion 22 and from a back surface 50 of the second portion 24 toward a front surface 54 of the second portion 24. While two mounting holes 48 are shown in each portion 22, 24 of the hinge body 18, other amounts of mounting holes 48 are contemplated. Sealing members 56, such as an o-ring, can surround the mounting holes 48 to help seal the hinge body 18 when attached to the enclosure 12. As illustrated in FIGS. 6, 9, and 10, fasteners 57, including, but not limited to, screws, can be used to attach the first portion 22 of the hinge body 18 and the second portion 24 of the hinge body 18 to the enclosure 12. The first portion 22 of the hinge body 18 can be attached to the door 16 and the second portion 24 can be attached to the enclosure frame 14. Alternatively, the first portion 22 of the hinge body 18 can be attached to the enclosure frame 14 and the second portion 24 can be attached to the door 16. Advantageously, the mounting holes 48 do not extend all the way to the front surfaces 52, 54 of the hinge portions 22, 24 so that the fasteners 57 are not accessible from the exterior of the enclosure 12. This feature helps to provide the tamper-proof nature of the hinge apparatus 10 as well as provide a clean aesthetic for the hinge apparatus 10 on the enclosure 12 when viewed from the exterior. Additionally, because the hinge apparatus 10 can be designed to be mounted exterior to the enclosure frame 14 and door 16, the hinge apparatus 10 can provide more space for the components contained within the enclosure 12 as well as for installing, servicing, or performing other activities on the components housed within the enclosure 12.

Figure 5:
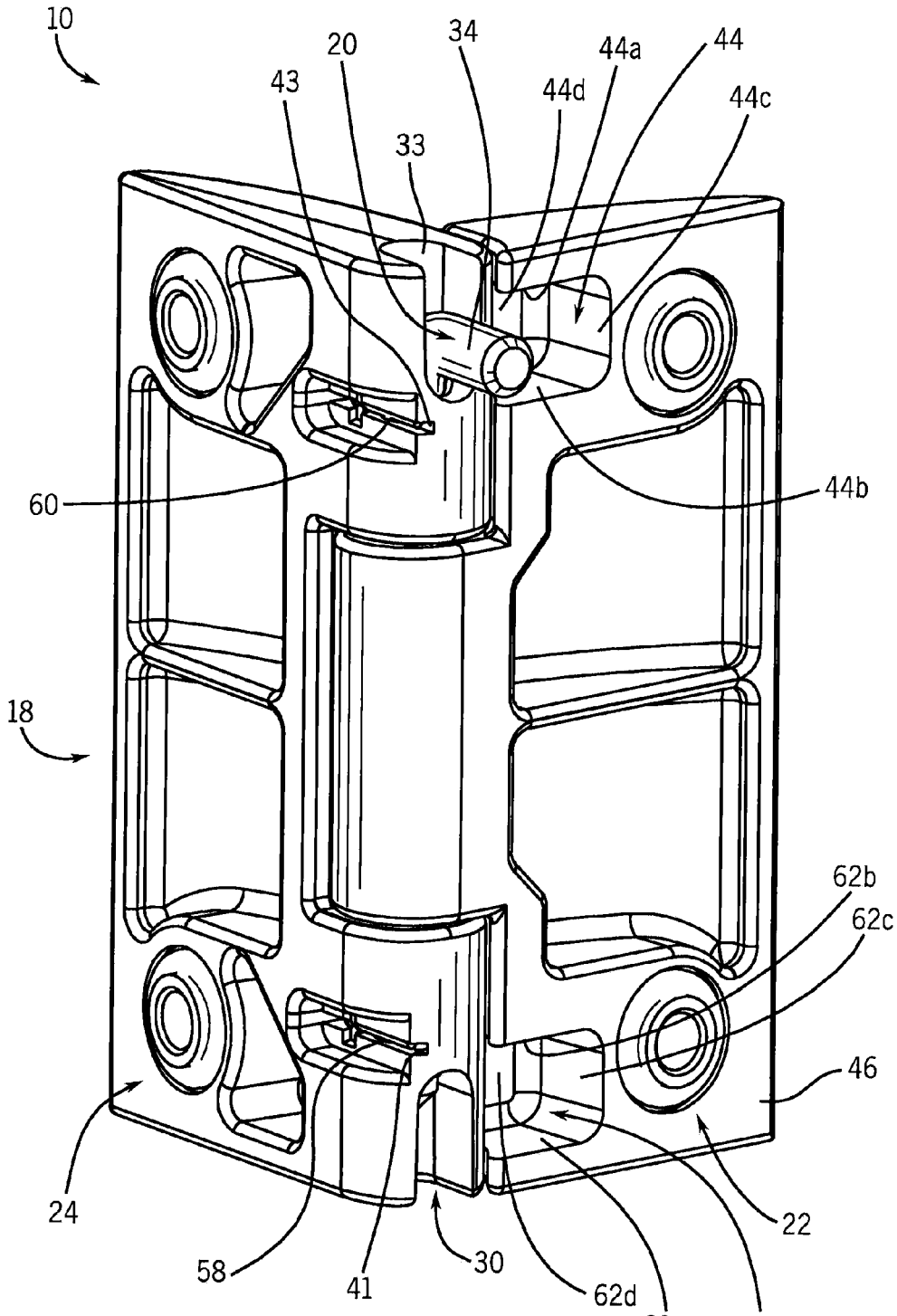
FIG. 5 is a rear perspective view of the hinge apparatus of FIG. 3.

As illustrated in FIGS. 4-6, one of the first portion 22 of the hinge body 18 and the second portion 24 of the hinge body 18 can include a recess 44. The first portion 22 includes the recess 44 in the embodiment displayed in FIGS. 1-11. The recess 44 can be defined by a back surface 46 of the first portion 22, which is configured to be substantially co-planar with the door 16 of the enclosure 12 when attached to the door 16. Thus, the recess 44 can help prevent access to the hinge pin 20 when the door 16 and hinge body 18 are in the closed position, as illustrated in FIG. 6. As illustrated in FIG. 5, the recess 44 can include a top surface 44*a*, a bottom surface 44*b*, a side surface 44*c*, and a front surface 44*d*. The surfaces 44*a*-44*d* of the recess 44 encapsulate the gripping portion 34 of the hinge pin 20 when the hinge body 18 and door 16 are in the closed position to render the gripping portion 34 inaccessible when the door 16 and hinge body 18 are in the closed position. Because the gripping portion 34 of the hinge pin 20 is encapsulated and rendered inaccessible by the recess 44 when the hinge body 18 and door 16 are in the closed position, the hinge apparatus 10 is tamper-proof.

As illustrated in FIGS. 3, 5, and 10, when the door 16 and hinge body 18 are moved to an open position, the gripping portion 34 of the hinge pin 20 is removed from the recess 44. As the door 16 and first hinge body 22 are rotated to move the door 16 and hinge body 18 into the open position, an internal side 33 of the first knuckle portion 28 prevents the gripping portion 34 from rotating and remaining in the recess 44, and thus, removes the gripping portion 34 from the recess 44. In an alternative configuration where the first portion 22 of the hinge body 18 is attached to the enclosure frame 14 and the second portion 24 of the hinge body 18 is attached to the door 16, the internal side 33 of the first knuckle portion 28 will remove the gripping portion 34 from the recess 44 as the door 16 and the second hinge body 24 are rotated to move the door 16 and hinge body 18 into the open position. Thus, in either configuration, the hinge body 18 can automatically remove the gripping portion 34 from the recess 44 as the hinge body 18 and door 16 are moved to the open position. Due to this feature, no tools are necessary for removing the gripping portion 34 from the recess 44. Additionally, appropriate personnel do not need to spend time or effort removing the gripping portion 34 of the hinge pin 20 from the recess 44 when desiring to disassemble the hinge body 18. Once the gripping portion 34 is removed from the recess 44, appropriate personal having the ability to open the door 16 of the enclosure 12 can vertically move the hinge pin 20 to remove at least a portion of the hinge pin 20 from the tubular opening 30, as described in further detail below, to allow the hinge apparatus 10 to be disassembled.

The hinge apparatus 10 can also include a first retaining member 58 and a second retaining member 60. As illustrated in FIGS. 4, 5, and 7-11, the first retaining member 58 can be held within slot 41 of the hinge body 18 and can assist in retaining the hinge pin 20 in the tubular opening 30. The first retaining member 58 can be a pin that is biased toward the tubular opening 30 due to its angled shape and its fit within the slot 41. When the hinge pin 20 is inserted into the tubular opening 30, the first retaining member 58 can engage the first annular groove 36 of the hinge pin 20.

The second retaining member 60 can be located above the first retaining member 58 and can be held within slot 43 of the hinge body 18. The second retaining member 60 can also be biased toward the tubular opening 30 due to its angled shape and its fit within slot 43, similar to that as described above with respect to the first retaining member 58. When the hinge pin 20 is fully inserted into the tubular opening 30 as illustrated in FIG. 7, the second retaining member 60 can engage the axial portion 32 of the hinge pin 20.

Figure 8:
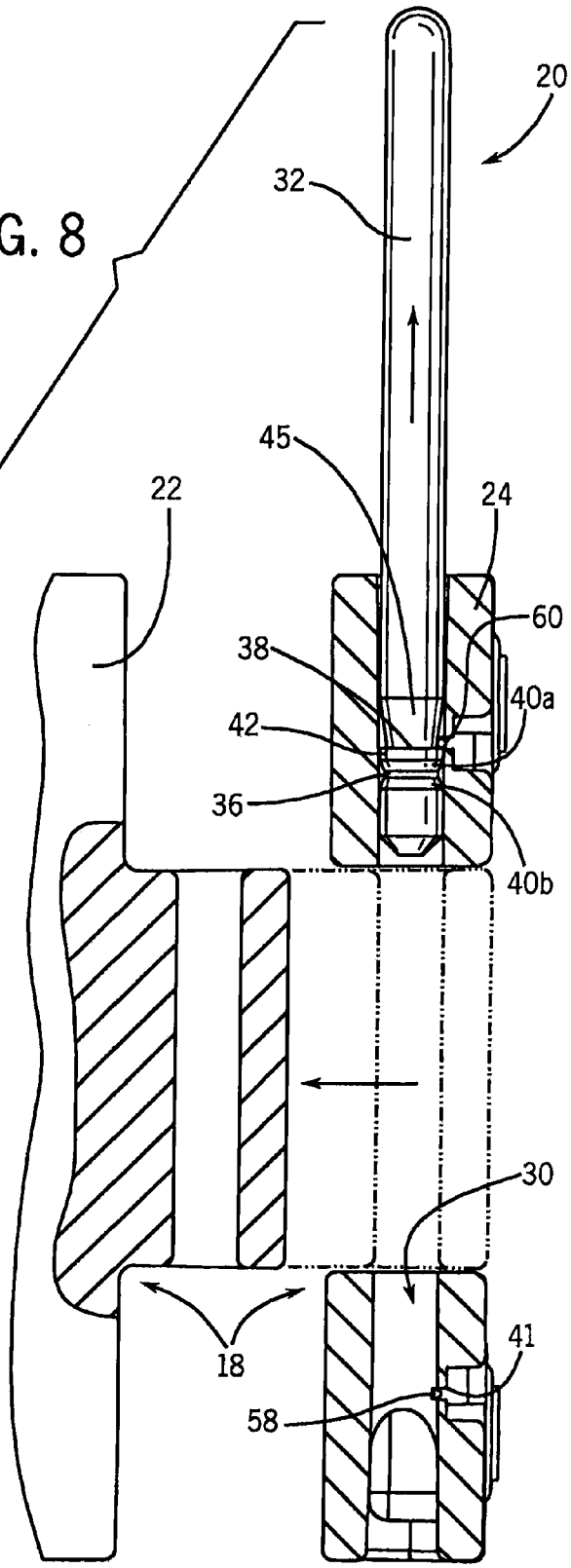
FIG. 8 is a cross-sectional view similar to that of FIG. 6, with the hinge body being in the open position and the hinge pin being removed from the tubular opening.

Appropriate personnel may desire to remove the door 16 from the enclosure 12 from time to time to perform maintenance, installation, or other activities upon the equipment housed within the enclosure 12. After opening the door 16, the gripping portion 34 is removed from the recess 44 as described above and as shown in FIGS. 3 and 5. The hinge pin 20 can then be pulled vertically upwards from the tubular opening 30 in the hinge body 18 as illustrated in FIG. 8. In doing so, the first retaining member 58 will engage the tapered portion 40*b* and then the axial portion 32 of the hinge pin below the tapered portion 40*b*. The slot 41 in the hinge body 18 for the first retaining member 58 allows the first retaining member to be deflected away from the tubular opening 30 as the hinge pin 20 is pulled from the tubular opening 30.

As the hinge pin 20 is pulled upwards from the tubular opening 30, the second retaining member 60 continues to engage the axial portion 32 of the hinge pin 20 until the second retaining member 60 engages a tapered portion 45 above the second annular groove 38. Eventually, the second retaining member 60 engages the second annular groove 38 and shoulder 42 as illustrated in FIG. 8. Because of the abrupt nature of the shoulder 42, personnel will experience more resistance to moving the hinge pin 20 in an upward direction in the tubular opening 30 at this point. In this position, a sufficient amount of the hinge pin 20 is removed from the tubular opening 30 such that the first portion 22 of the hinge body 18 can be separated from the second portion 24 of the hinge body 18, however, the hinge pin 20 can still remain engaged with the second portion 24 because the second retaining member 60 can reside in the second annular groove 38 as noted above. This can help the hinge pin 20 from being misplaced when the hinge apparatus 10 is disassembled.

The hinge apparatus 10 can also include a secondary recess 62 so that the hinge apparatus 10 and hinge body 18 are reversible. The hinge apparatus 10 illustrated in FIGS. 1-11 is arranged such that the door 16 is opened by hinging on its right side as viewed from the exterior of the enclosure 12. The secondary recess 62, however, allows the hinge apparatus 10 and hinge body 18 to be arranged such that a door 16 can be opened by hinging on its left side as viewed from the exterior of the enclosure 12. In such an arrangement, the hinge apparatus 10 would be rotated 180° in the plane of the door 16 and the first portion 22 of the hinge body 18 could be attached to the left side of the door 16 and the second portion 24 of the hinge body 18 could be attached to the enclosure frame 14 to the left of the door 16. As illustrated in FIG. 5, the secondary recess 62 includes a top surface 62*a*, a bottom surface 62*b*, a side surface 62*c*, and a front surface 62*d*. Top surface 62*a* and bottom surface 62*b* are inverted with respect to the top surface 44*a* and bottom surface 44*b* of recess 44 due to the fact that the hinge body 18 is rotated when the secondary recess 62 is used. The secondary recess 62 can provide the same advantages of recess 44 as noted above when used in such a reversible arrangement.

Advantageously, the hinge apparatus 10 provides a tamper-proof design that can prevent access to the hinge pin 20 when the hinge body 18 and door 16 are in the closed position, but can allow access to the hinge pin 20 when the hinge body 18 and door 16 are in the open position. Additionally, the hinge apparatus 10 provides for toolless operation for removing the hinge pin 20 from the tubular opening 30 to remove the door 16 of the enclosure 12 because the hinge body 18 is designed such that the gripping portion 34 is removed from the recess 44 upon moving the hinge body 18 to the open position which allows personnel to vertically move the hinge pin 20 a sufficient amount by hand to separate the first portion 22 of the hinge body 18 from the second portion 24 of the hinge body 18.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. As but one example, while the embodiment disclosed in FIGS. 1-11 shows a hinge body 18 attached to the enclosure 12 as a separate unit, it is contemplated that the hinge body 18 can be modified to be integral to the enclosure 12.

The invention claimed is:

1. A hinge apparatus configured to move between a closed position and an open position, the hinge apparatus comprising:

a hinge body including a first portion pivotally connected to a second portion, the first portion having a first knuckle portion and the second portion having a second knuckle portion, the first knuckle portion and the second knuckle portion defining a tubular opening when aligned, and one of the first portion and the second portion including a recess; and a hinge pin including an axial portion and a gripping portion, the gripping portion being offset from an axis of the hinge pin;

the axial portion of the hinge pin being received by the tubular opening and the gripping portion of the hinge pin being received by the recess to inhibit access to the gripping portion when the hinge body is in the closed position, the gripping portion being removed from the recess as the hinge body is moved to the open position.

2. The hinge apparatus of claim 1, wherein the recess is defined by a back surface of the one of the first portion and the second portion including the recess.

3. The hinge apparatus of claim 2, wherein the recess includes a top surface, a bottom surface, a side surface, and a front surface that encapsulate the gripping portion such that the gripping portion is inaccessible when the hinge body is in the closed position.

4. The hinge apparatus of claim 1, further comprising a first retaining member, wherein the hinge pin further includes a first annular groove and the first retaining member engages the first annular groove to assist in retaining the hinge pin in the tubular opening.

5. The hinge apparatus of claim 4, further comprising a second retaining member, wherein the hinge pin further includes a second annular groove providing a shoulder and the second retaining member engages the second annular groove and shoulder to retain a portion of the hinge pin in the hinge body during disassembly of the hinge apparatus.

6. The hinge apparatus of claim 5, wherein the first retaining member and the second retaining member are biased towards the tubular opening.

7. The hinge apparatus of claim 1, wherein the first portion includes at least one mounting hole and the second portion includes at least one mounting hole, the at least one mounting hole of the first portion extending from a back surface of the first portion towards a front surface of the first portion and the at least one mounting hole of the second portion extending from a back surface of the second portion towards a front surface of the second portion.

8. The hinge apparatus of claim 7, wherein the at least one mounting hole of the first portion does not extend completely through to the front surface of the first portion and the at least one mounting hole of the second portion does not extend completely through to the front surface of the second portion.

9. The hinge apparatus of claim 1, wherein the one of the first portion and the second portion including the recess further includes a secondary recess, such that the hinge apparatus is reversible.

10. A hinge body configured to move between a closed position and an open position, the hinge body comprising:

a first portion having a first knuckle portion; and a second portion having a second knuckle portion;

the first knuckle portion and the second knuckle portion defining a tubular opening when aligned, said tubular opening adapted to receive a hinge pin having a gripping portion one of the first portion and the second portion having a recess, the recess inhibiting access to a gripping portion of the hinge pin when the hinge body is in the closed position, the hinge body removing the gripping portion from the recess as the hinge body is moved to the open position.

11. The hinge body of claim 10, wherein the recess is defined by a back surface of the one of the first portion and the second portion including the recess.

12. The hinge body of claim 11, wherein the recess includes a top surface, a bottom surface, a side surface, and a front surface that encapsulate the gripping portion such that the gripping portion is inaccessible when the hinge body is in the closed position.

13. The hinge body of claim 10, further comprising a first retaining member biased towards the tubular opening.

14. The hinge body of claim 13, further comprising a second retaining member biased towards the tubular opening.

15. The hinge body of claim 10, wherein the first portion includes at least one mounting hole that extends from a back surface of the first portion towards a front surface of the first portion but does not extend completely through to the front surface of the first portion and the second portion includes at least one mounting hole that extends from a back surface of the second portion towards a front surface of the second portion but does not extend completely through to the front surface of the second portion.

16. The hinge body of claim 10, wherein the one of the first portion and the second portion including the recess further includes a secondary recess, such that the hinge body is reversible.

17. An enclosure comprising:

an enclosure frame;

a door, the door configured to move between an open position and a closed position;

a hinge body including a first portion pivotally connected to a second portion, the first portion having a first knuckle portion and the second portion having a second knuckle portion, the first knuckle portion and the second knuckle portion defining a tubular opening when aligned, and one of the first portion and the second portion including a recess; and a hinge pin including an axial portion and a gripping portion;

the axial portion of the hinge pin being received by the tubular opening and the gripping portion of the hinge pin being received by the recess to inhibit access to the gripping portion when the door is in the closed position, the gripping portion being removed from the recess as the hinge body is moved to the open position.

18. The enclosure of claim 17, wherein the recess is defined by a back surface of the one of the first portion and the second portion including the recess, the back surface of the one of the first portion and the second portion including the recess being substantially co-planar with the door.

19. The hinge body of claim 18, wherein the recess includes a top surface, a bottom surface, a side surface, and a front surface that encapsulate the gripping portion such that the gripping portion is inaccessible when the door is in the closed position.

20. The enclosure of claim 17, wherein the hinge body further includes a first retaining member and the hinge pin further includes a first annular groove, the first retaining member being biased towards the tubular opening and engaging the first annular groove to assist in retaining the hinge pin in the tubular opening.

21. The enclosure of claim 20, wherein the hinge body further includes a second retaining member and the hinge pin further includes a second annular groove providing a shoulder, the second retaining member being biased towards the tubular opening and engaging the second annular groove and shoulder to retain a portion of the hinge pin in the hinge body during disassembly of the first portion from the second portion.

22. The enclosure of claim 17, wherein the first portion includes at least one mounting hole and the second portion includes at least one mounting hole, the at least one mounting hole of the first portion extending from a back surface of the first portion towards a front surface of the first portion and the at least one mounting hole of the second portion extending from a back surface of the second portion towards a front surface of the second portion, the first portion is attached to the door, the second portion is attached to the enclosure frame, and the first portion includes the recess.

23. The enclosure of claim 17, wherein the one of the first portion and the second portion that includes the recess further includes a secondary recess, such that the hinge body is reversible.

24. The enclosure of claim 17, wherein the hinge body and the hinge pin are exterior to the enclosure frame and the door.

* * * * *